United States Patent [19]

Barrett

[11] 4,300,366

[45] Nov. 17, 1981

[54] OVERHEAD CONVEYOR SYSTEM FOR GARMENT PROCESSING CABINET

[75] Inventor: Barrie G. Barrett, Ashford, England

[73] Assignee: C. F. Doyle Limited, Faversham, England

[21] Appl. No.: 127,763

[22] Filed: Mar. 6, 1980

[30] Foreign Application Priority Data

Mar. 13, 1979 [GB] United Kingdom ..... 08867/79

[51] Int. Cl.[3] ..... D06F 35/00

[52] U.S. Cl. ..... 68/3 R; 198/416; 198/580; 198/795

[58] Field of Search ..... 68/3 R, 5 C; 198/416, 198/472, 580, 795

[56] References Cited

U.S. PATENT DOCUMENTS

| | | | |
|---|---|---|---|
| 1,566,899 | 12/1925 | Wigglesworth | 198/472 X |
| 2,667,981 | 2/1954 | Tusting et al. | 198/472 X |
| 2,681,132 | 6/1954 | Knutson | 198/580 |
| 2,986,263 | 5/1961 | Jones | 198/472 X |
| 3,521,738 | 7/1970 | Coleman | 198/472 X |
| 3,644,085 | 2/1972 | Beeley et al. | 68/5 C X |
| 4,070,876 | 1/1978 | Thompson et al. | 68/3 R |

*Primary Examiner*—Philip R. Coe

*Attorney, Agent, or Firm*—Wood, Herron & Evans

[57] ABSTRACT

Garment treatment apparatus include one or more cabinets in which garments carried by hangers are treated by, for example, spraying and heating. However, to restrict loss of heat or processing medium from the cabinet the entrance and exit from the cabinet should be as narrow but at the same time the cabinet should not be too long. Therefore, the garment supports are passed into and out from the cabinet with the support positioned so that a garment or the support has its narrowest dimension transverse with the direction of entry and exit. Thus if the garment is a jacket, one shoulder leads into the cabinet and the other trails. Once in the cabinet, however, means are provided to change the direction of movement of the support, e.g. through 90°, without rotating the support so that a garment on the support may be moved through at least part of the cabinet with its narrowest dimension changed with the longitudinal axis of that part of the cabinet. Thus, if the garment is a jacket, its shoulder to shoulder line will be transverse to the cabinet axis or then direction of advance, a number of jackets being treated all being arranged with their shoulder lines parallel to one another in a close packed formation.

15 Claims, 13 Drawing Figures

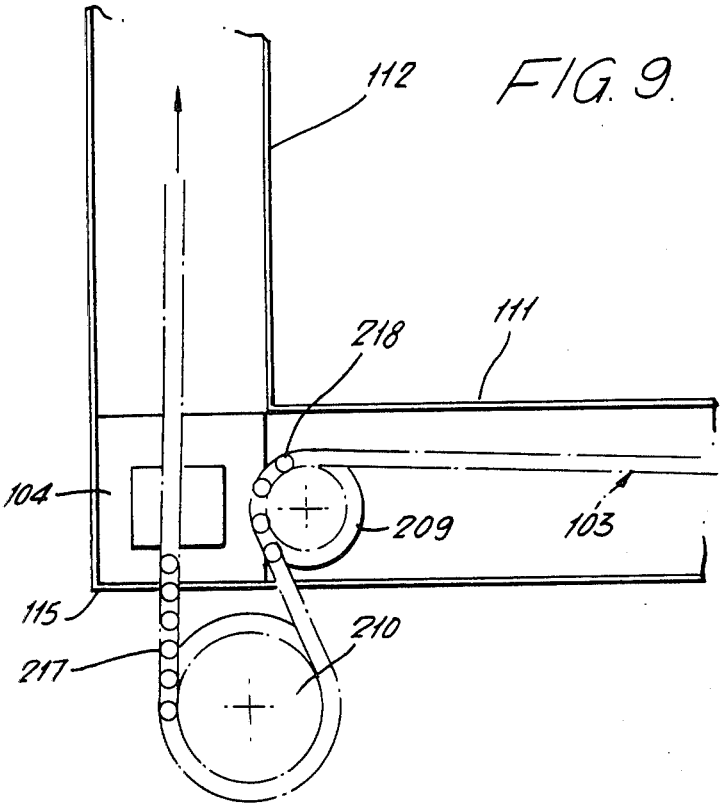
FIG. 13.
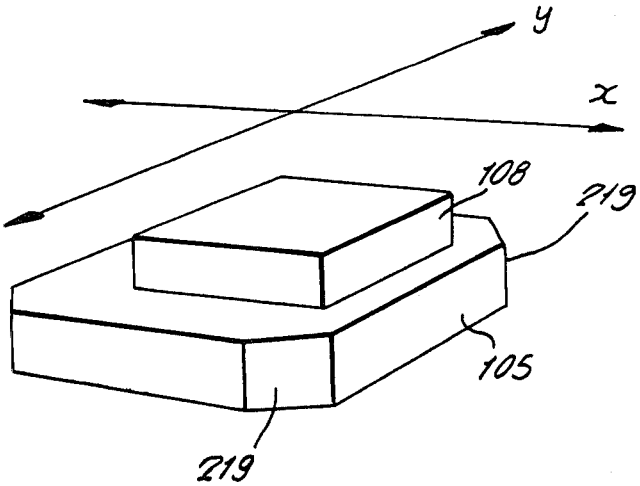

OVERHEAD CONVEYOR SYSTEM FOR GARMENT PROCESSING CABINET

This invention relates to garment treatment or processing apparatus and in particular to garment treatment or processing apparatus comprising one or more longitudinal cabinets through which garments held on garment supports such as hangers or the equivalent are moved by a conveyor or conveyors for appropriate treatment.

BACKGROUND TO THE INVENTION

This type of garment treatment apparatus is often used for laundering garments and it is then convenient to provide both cleaning or processing and finishing treatment which may be carried out in one or more cabinets positioned along the length of a conveyor circuit which is often a closed circuit. The garments are fed onto and unloaded from the conveyor at loading and unloading stations, respectively, which are located externally of the cabinets, by for example gravity or power-operated devices, the hangers and garments being arranged to travel to and from the loading and unloading stations and through the treatment cabinets with the greatest width of garment, i.e. shoulder to shoulder, normal to the direction of advance of conveyor.

In order to restrict the loss of heat, airflow or other processing medium from within the cabinet to the surrounding environment, it is economically desirable to pass the garment on its hanger or equivalent support into and out from a cabinet through the narrowest practical aperture which can then be provided with the most efficient sealing "door". However, whilst within the cabinet, the garments are desirably relatively closely packed with the hangers parallel to one another so that the size of the cabinets is not too large.

The invention has therefore been made with these points in mind.

BRIEF SUMMARY OF THE INVENTION

According to the invention, there is provided garment treatment apparatus in which garments held on garment supports such as hangers are moved by one or more conveyors for treatment through one or more treatment cabinets, the garment supports being passed into and/or out from at least one cabinet with the support positioned so that a garment on the support will have its narrowest dimension substantially traverse with the direction of entry into and/or exit from the cabinet, e.g. if the garment is a jacket, one shoulder of the jacket will be leading and the other trailing, and means being provided for changing the direction of movement of the support, e.g. through 90°, without rotating the support whilst the support is within the cabinet so that a garment on the support may be moved through at least part of the cabinet with its narrowest dimension aligned with the longitudinal axis of that said part of the cabinet, e.g. for a jacket its shoulder to shoulder line will extend transversely of the cabinet axis or then direction of advance through that part of the cabinet.

Hence, the entrance and/or exit aperture of the cabinet may be made very narrow whilst allowing the garment to travel in a closer packed formation and, preferably at a slower rate, through a part of the interior of the cabinet. Such apparatus is not only more efficient than those proposed hitherto but the cabinet or cabinets may be shorter.

If the garment is both to enter and leave the cabinet through a narrow aperture, the garment support preferably changes its direction of travel by a further 90° whilst not turning itself and whilst within the cabinet. This may be carried out in such a way that the shoulder of a garment on the support which was trailing on entry, leads as the garment leaves the cabinet and the shoulder which was leading on entry, trails. The direction of travel of the garment support is in this case moved through 180° between entering and leaving the cabinet. Alternatively, the garment support prior to leaving the cabinet may change its direction of travel by 90° whilst not turning itself, in such a way that the shoulder which was trailing on entry is trailing as it leaves the cabinet and equally, the shoulder of the garment which led on entry leads as the garment leaves the cabinet.

The garment supports may be suspended from a single overhead conveyor which either travels in a closed circuit or forms part of a larger treatment system of which the cabinet may be only one of a series of cabinets or other installations or apparatus.

The garments are loaded onto their hangers and unloaded therefrom as close to the inlet and exit apertures of the cabinet or cabinets as is practically possible without trapping the garments in the doors of the apertures in order to give a high "processing time to conveyed time" ratio.

If an overhead conveyor system is used where garments on hangers are conveyed under gravity suspension and the garments travel along at least a part of their circuit with one shoulder leading in the direction of travel, then it will be appreciated that the pitch of the suspension points at which the hangers are suspended from the conveyor is preferably the same as or greater than the "across the shoulders" dimension of the garment in order to avoid overlap of the garments. This arrangement will be necessary if the garment is for example to be sprayed whilst within the cabinet and if spray coverage of all parts of the garment is required.

Thus the spray section of a cabinet is conveniently positioned adjacent the inlet whilst the garment is still travelling with one shoulder leading and prior to change of direction of travel of the support within the cabinet. Once the change of direction has taken place within the cabinet, the garments will preferably travel closer together with the fronts and backs not fully accessible to spray process and at a lower speed than that at entry or exit. This slower speed and closer packing of the garments enables further treatment, e.g. heat treatments, of the garments to be made without unduly enlarging the cabinets.

In order to avoid synchronisation problems of having two powered conveyor drives with variable speed control, one to move the garment supports at a slower speed within the cabinet and the other for movement through the inlet and exit of the cabinet and external to the cabinet, either the higher speed inlet and exit conveyor may be linked to a slower speed closed circuit conveyor within the cabinet via a reduction gear system or the higher speed conveyor system may be arranged to disengage the garment supports at the point where the direction of travel changes and be arranged to re-engage the garments or supports at the second point where their direction of travel changes. The garments are moved through this section in steps as the arrival of each new garment support at the beginning of the section preferably acts to push all the other supports in the section, forward by a distance equal to the length of a support.

BRIEF DESCRIPTION OF THE DRAWINGS

The invention will now be described by way of example, with reference to the accompanying drawings, in which:

FIGS. 9 and 10 are plan views of corners of the apparatus illustrating yet further alternative arrangements of the conveyor;

FIG. 13 is a perspective view of an alternative shape of block.

DESCRIPTION OF THE PREFERRED EMBODIMENT

Figure 1:
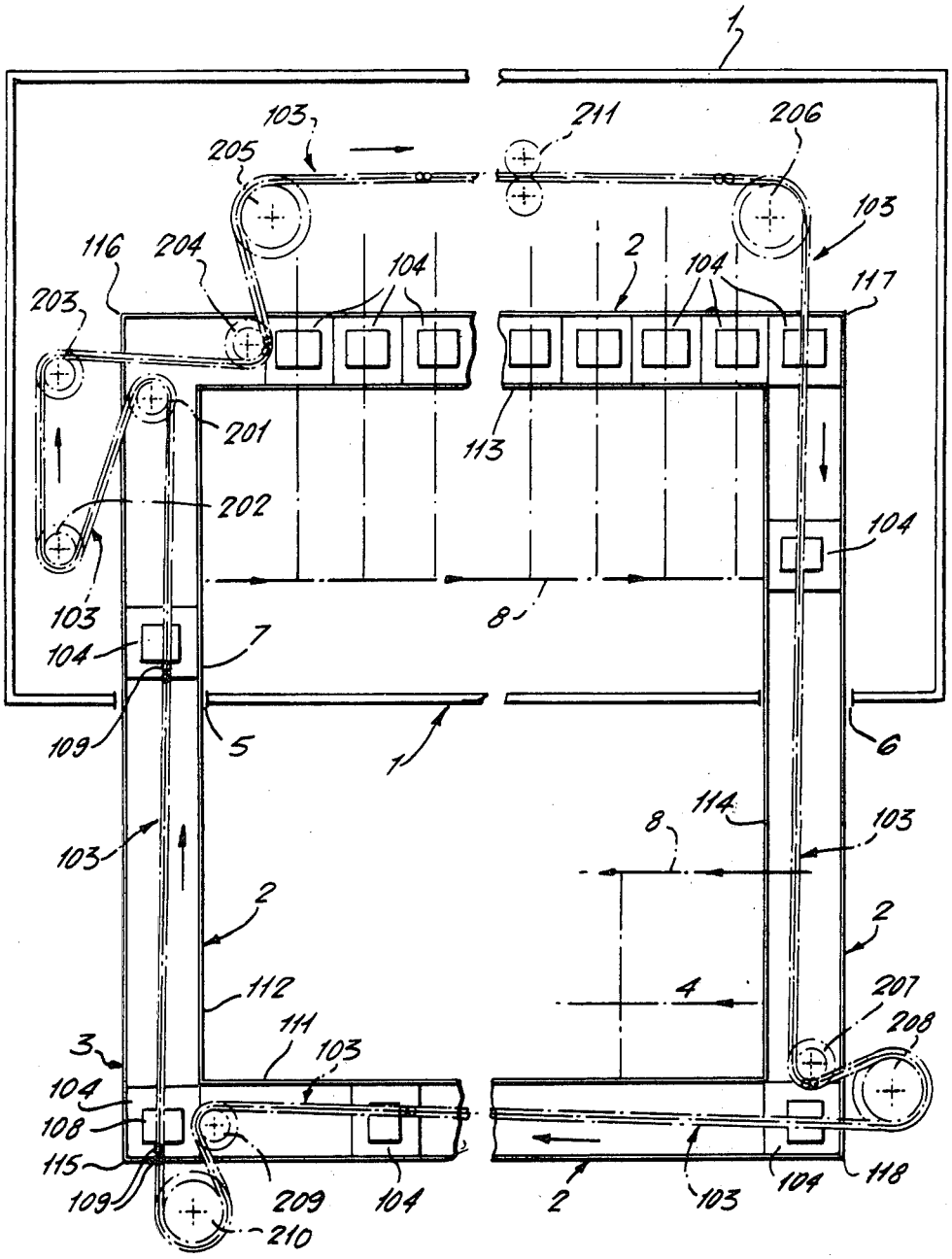
FIG. 1 is a schematic plan view of one embodiment of garment treatment apparatus in accordance with the invention.

The apparatus illustrated in FIG. 1 comprises an overhead conveyor 2 which moves in a closed circuit in the direction illustrated by the arrows and into and out from a processing cabinet 1.

Garments to be treated are loaded onto supports carried by a conveyor chain 103 at a loading station 3 at the bottom left-hand corner 115 of the track as shown in FIG. 1. The garments are then carried by the conveyor along a track length 112 and through an entrance 5 to the cabinet with one shoulder leading and the other trailing. The garments continue in a straight line path for a short distance in the cabinet. The direction of movement of the garments along the track is however turned through 90° at the corner 116 within the cabinet and the garments are then moved at a slower rate along the section 113 of the cabinet during which movement they are more tightly pressed together with their shoulders extending transversely to the direction of movement. The direction of movement is changed once again at the corner 117 and the garments then leave the cabinet through an exit 6 with one shoulder leading and the other trailing.

The garments are discharged from the garment supports along the length of track 114 shortly after leaving the cabinet.

The conveyor track then turns through a further 90° at corner 118 and moves along a length 111 back to the garment loading station 3 at corner 115.

Figure 2:
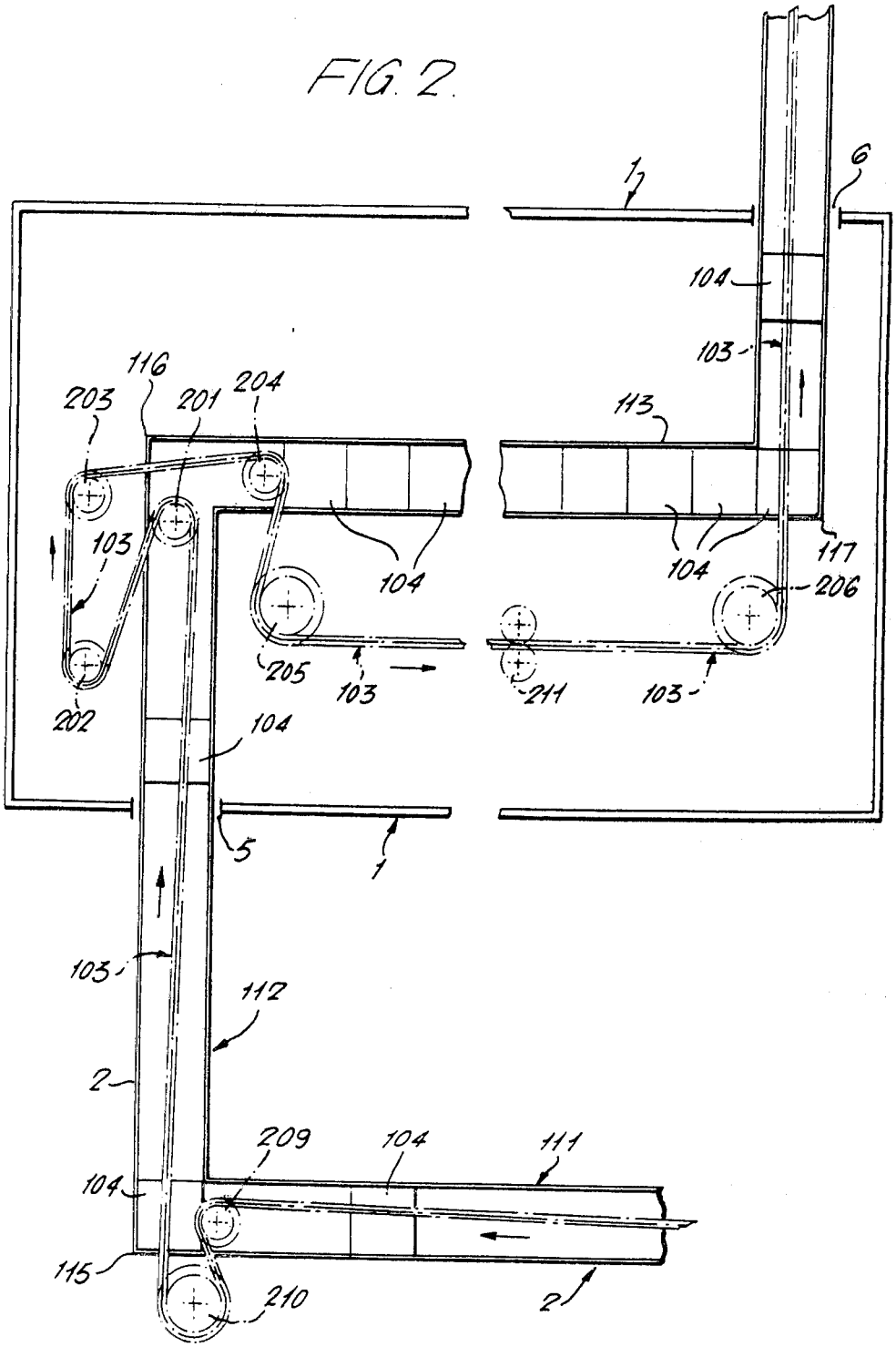
FIG. 2 is a schematic plan view of part of another embodiment of garment treatment apparatus in accordance with the invention.

The apparatus illustrated in FIG. 2 differs from that of FIG. 1 in that the direction of movement of the garments along track length 113 is turned through 90° at corner 117 in the opposite direction from that illustrated in FIG. 1 so the shoulder of the garment which led as the garment entered the cabinet 1 also leads as the garment leaves the cabinet through the exit 6. The conveyor then passes through a further series of cabinets/-treating apparatus (not shown) before rejoining the illustrated track along track length 111.

Figure 3:
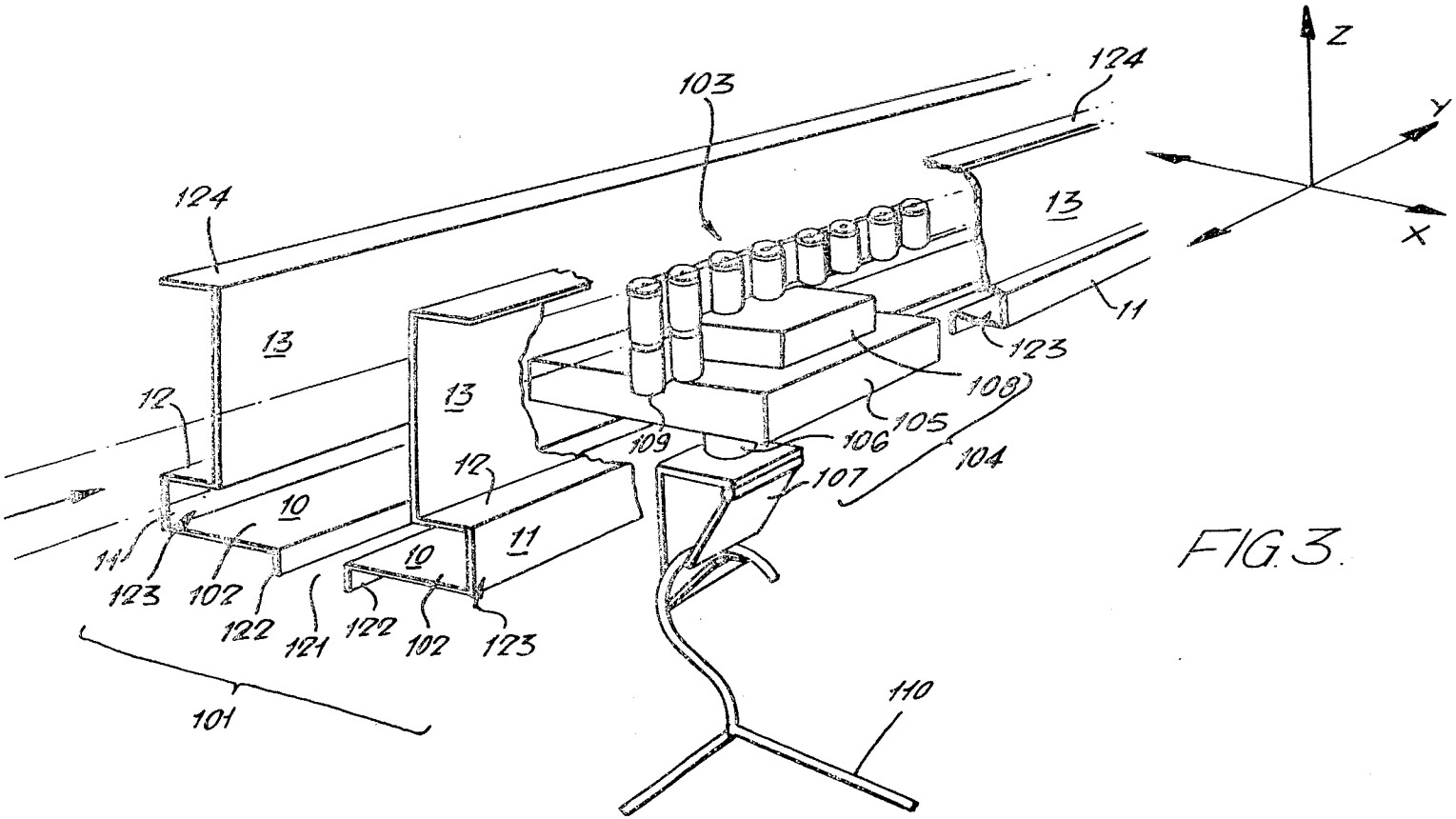
FIG. 3 is a detail, partly broken away, of a part of the conveyor and garment support used in the apparatus of either FIG. 1 or FIG. 2.

Referring to FIG. 3, it will be seen that the conveyor track 101 comprises two elongate track sections 102, a conveyor chain 103 and various sprockets and/or chain wheels to guide the support and drive the conveyor chain. The conveyor chain carries a number of garment support units 104.

Each track section 102 is made of press-folded thin gauge stainless steel sheet and as can be seen, the two sections are mounted symmetrically about centre lines in the Y and Z axes (illustrated at the right-hand side of FIG. 3) having two downwardly folded flanges 122 for bridging the gap 121 left between two horizontal slide surfaces 10. The slide surfaces are bounded by upright and upper horizontal surfaces 11 and 12 to form a trackway 123. The upper portion of the sections 102 have an upright face 13 and terminate in horizontal outwardly folded flanges 124.

The track sections are suspended from brackets (not shown) connected to the upper flanges 124.

The conveyor chain 103 moves predominantly between the upright faces 13 of the two track sections 102 and drives the garment support units 104.

Each unit 104 comprises a square block 105 of polytetrafluoroethylene (P.T.F.E.) of other non-corrodible low coefficient of friction material which engages in the trackway to rest on the two horizontal slide surfaces 10 of the two sections, bridging the gap 121. The block 105 supports a downwardly extending bar 106 holding a conveyor hook device 107 for receiving and holding a garment hanger 110. The bar 106 passes through the block 105 and engages in a steel square head 108 which has smaller dimensions than the block 105 and is engaged by conveyor chain pins 109 which extend downwardly from the main conveyor chain 103.

The block 105 is prevented from sideways movement by the upright surfaces 11 of the conveyor track members and the suspension bar 106 passes down through the gap 121 so that a garment on the hanger 110 is held suspended below the conveyor track sections. Movement of the slide blocks 105 along the surfaces 10 is restrained to take place only in the horizontal direction with vertical restraint in the Z axis and twisting restraint in the X-Y plane being provided by other surfaces of the trackway 123. The material of the track sections and blocks is chosen to provide a low coefficient of friction in a hostile environment containing moisture, dust and hot air with temperatures in the region of 66° C.

The conveyor chain 103 moves each garment support unit 104 by pushing it along the tracks, by engagement of the pins 109 with the rearward edge of the heads 108 of the suspension units as illustrated in FIG. 3.

Sprockets or chain wheels for the conveyor chain 103 are located between the upper 124 and lower 122 flanges of the conveyor track, some located between the pairs of track sections 102 and some external to the track itself.

The upper vertical webs 13 of the track section are cut away at various points along the length of the tracks (see for example gaps 119 and 120 in FIG. 4) to enable the conveyor chain 103 to pass from between the track sections and back again whilst the slide blocks 105 are still constrained to slide along the trackway 10 in the track sections of the conveyor.

Referring to FIG. 1, a garment to be treated by the apparatus is loaded onto a hanger 110 at the loading station 3 at the track corner 115. Whilst loading takes place, the garment support unit 104 remains stationary as the conveyor chain 103 which has previously moved the slide block 105 of unit 104 into the corner, is guided by sprockets 209 and 210 on a path out from between the track sections forming the length 111 of the circuit so that the drive pins 109 disengage from the block.

As the conveyor chain is guided between the track sections of track length 112 which is at right angles to the length 111, the pins 109 again contact the head 108 of the support unit but at an edge which is at 90° to that which they previously engaged during movement along the track length 111.

Once the pins have contacted the head, the head 108, block 105 and hence the whole support unit 104 is pushed along the conveyor track length 112 towards the cabinet entrance 5. During this movement a garment on the hanger 110 is positioned so that one shoulder is leading and the other trailing, i.e. the narrowest garment dimension is positioned transverse to the direction of movement of the conveyor so that the garment can pass through the narrowest possible aperture in the cabinet.

Once a garment support unit 104 carrying a garment is within the cabinet 1 it passes through a garment spraying section 7 adjacent the cabinet entrance. As the widest garment surface faces the sides of the cabinet and since one garment does not overlap adjacent garments, the whole surface of the garment may be covered by spray.

The pins 109 continue to push unit 104 until the block 105 reaches the track corner 116 where the track turns through a right angle as can clearly be seen in FIG. 1. When the block has reached this corner, the conveyor chain 103 is guided by sprocket 201 and leaves the track through the gap 119 in the face 13 as can clearly be seen in FIG. 4. The pins carried by the chain roll off from the edge of the head 108 of the block 105 so that the block rests temporarily in the corner 116. One full pitch in advance of the pins 109 which have guided the block in question over the track length 112 is a further set of pins which has already been guided by sprockets 202 and 203 through 90° and on re-entry of the chain 103 through the end of the gap 119, these pins 109 engage the next adjacent edge at 90° in a clockwise direction (as seen in FIG. 1) of the head 108 of the block.

The support unit is then pushed clear of the corner in a direction at 90° to its previous direction along the first part of the track length 113 at the speed of the conveyor chain 103 so as to vacate the corner ready to receive the following slide block 105.

It will be appreciated that the direction of movement of a garment carried by the suspension unit has been changed through 90° at the corner 116 without any rotational movement of the garment itself. The garment is thus moved along the length 113 within the cabinet with its maximum shoulder width extending transversely to the direction of movement of the conveyor.

The major portion of the conveyor track length 113 is intended to be traversed at a slower speed than is the length 112 and it will be seen that the units 104 bunch-up against each other. As the conveyor chain reaches a sprocket 204 it is again fed out from the conveyor tracks through the gap 120 in the upright face 13 of the track section (see FIG. 4) so that the drive pins 109 again disengage from the heads of the slide blocks.

Movement of the blocks 105 along the length 113 is achieved by the fact that the last slide block to be pushed into this length of track by the pins 109 in turn pushes all the previous blocks in this length one block length forward, the garments on their hangers being now pitched at one block length. The blocks continue to move intermittently and relatively slower along this length until they reach the corner 117 where the conveyor track again turns through 90° towards the exit 6 of the cabinet. As a block reaches the corner 117, its head 108 is re-engaged by the pins 109 on the conveyor chain 103 as the chain is fed round sprocket 206 to re-enter the sections of track length 114, the pins 109 engaging the next face of the head positioned at 90° in a clockwise direction.

The conveyor chain is guided between its positions of leaving and re-entering the track sections of length 113 by sprockets 205, 211, and 206.

It will be appreciated that a block moving out from the corner 117 has changed its direction of movement by a further 90° (a total of 270° since it originally travelled unloaded on the track length 111).

A garment carried by a suspension unit now again travels with one shoulder leading and the other trailing. As the garment has not itself been turned relative to the block, the shoulder which was leading as it entered the cabinet through inlet 5 trails as it exits from the cabinet through the outlet 6.

It will be appreciated that the aperture of the exit 6 can again be made as narrow as possible due to the orientation of the garment being moved out from the cabinet.

Once the suspended garment has left the cabinet and the shoulders and sleeves are clear of the exit then its hanger 110 may be off-loaded from the hook 107 by a fixed slip-off guide rail (not shown but which is standard) before the suspension unit 104 reaches the corner 118 of the conveyor track.

The suspension unit 104, without a garment suspended therefrom, is finally pushed by the pins 109 of the conveyor chain into the corner 118 where the track turns through a further 90° in a clockwise direction. When the block has reached the corner, the conveyor chain is guided out from the tracks around sprocket 207 and then passes around a further sprocket 208 so that it re-enters the tracks moving in a direction substantially at right angles from its path of movement along the track length 114. The pins then re-engage the next clockwise adjacent face of the head 108 of the slide blocks to push the empty units 104 along the conveyor track length 111 back to the loading station 3 to complete the closed circuit.

A suitable drive or driving system may be connected to the conveyor chain 103 at any suitable position and may drive any of the sprockets shown but preferably one which has a fixed position relative to the track, e.g.

sprockets 201, 202, 203, 204, 207 and 209 and to a lesser extent sprockets 205, 208 and 210 because these sprockets desirably have the facility of being readily adjusted in order to synchronise the disengagement and re-engagement of the pins 109 with the block head 108 and to achieve effective chain tension. The sprockets shown may be driven directly by motor and gear reduction unit and/or via a motor, drive chain and sprocket arrangement to a common shaft.

Alternatively, a drive station 211 including drive sprockets may be positioned between sprockets 204, 205 and 206 where pin to block contact is not being made.

Figure 4:
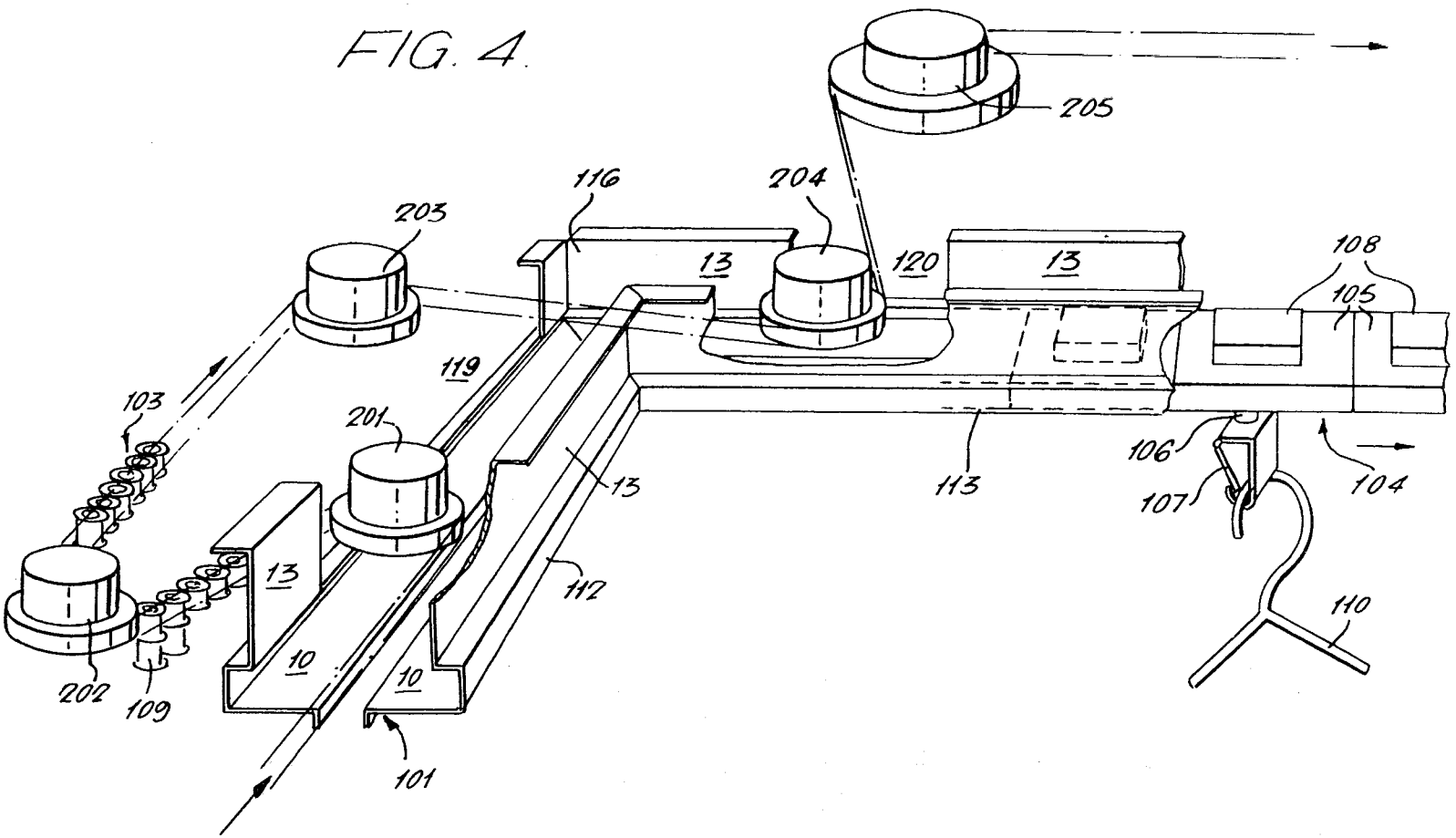
FIG. 4 is a detailed perspective view of one corner of the apparatus shown in either FIG. 1 or FIG. 2.

In order to facilitate the smooth transition of a slide block from one track length to another around a corner the corners may be mitred as shown at 116 in FIG. 4. The various track sections can readily be adjusted by vertical adjustment from their support brackets (not shown) and the fact that the conveyor track 101 is made in two open top sections allows these sections to be released from the support brackets in pairs of independently without disturbing the sprockets, pins or conveyor chain.

A garment support unit 104 may be readily moved from the conveyor track by simple removal of the one section 102 without disturbing the chain 103.

Pairs of pins 109 are illustrated in the drawings but a single pin or more than two could be employed, the pins either being fixed or rotatable about an axle attached to the conveyor chain. Indeed it may be desirable to have as many as six pins for each unit to enable smooth change of direction of the blocks at a corner.

The pins may be made from any suitable bearing material and it is preferred that they be free to rotate on extension spindles of the roller chain constituting the conveyor chain 103. When block 105 is pushed into a corner on the track then as the chain is moved away from the track sections by the sprocket positioned just before the corner, the trailing pin (of the pair shown in the drawing) acts to retain the block in a stationary position at a corner whilst the leading pin of the pair moves away sideways from its previous direction of travel. This reduces the tendency of the block to twist away from the desired "square" attitude prior to re-engagement at the corner by the next pair of pins.

Figure 5:
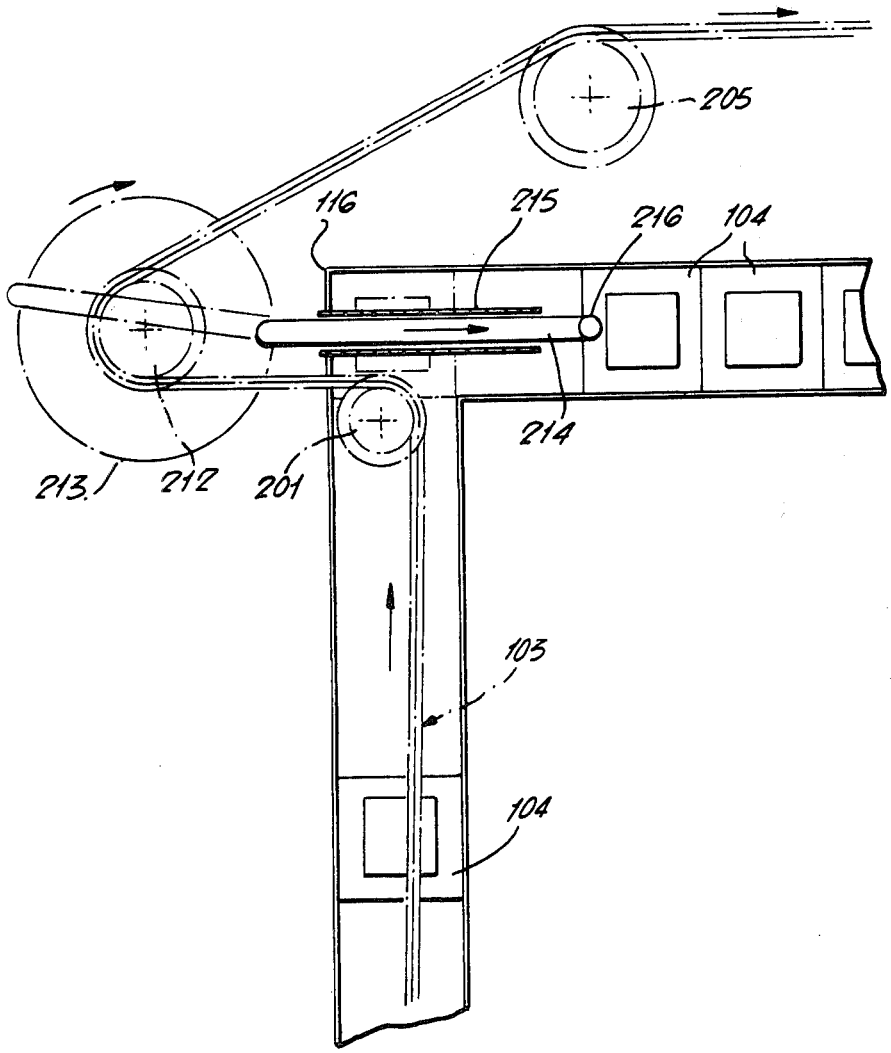
FIG. 5 is a plan view of a corner of the apparatus of either FIG. 1 or FIG. 2, showing an alternative arrangement of the conveyor.
Figure 6:
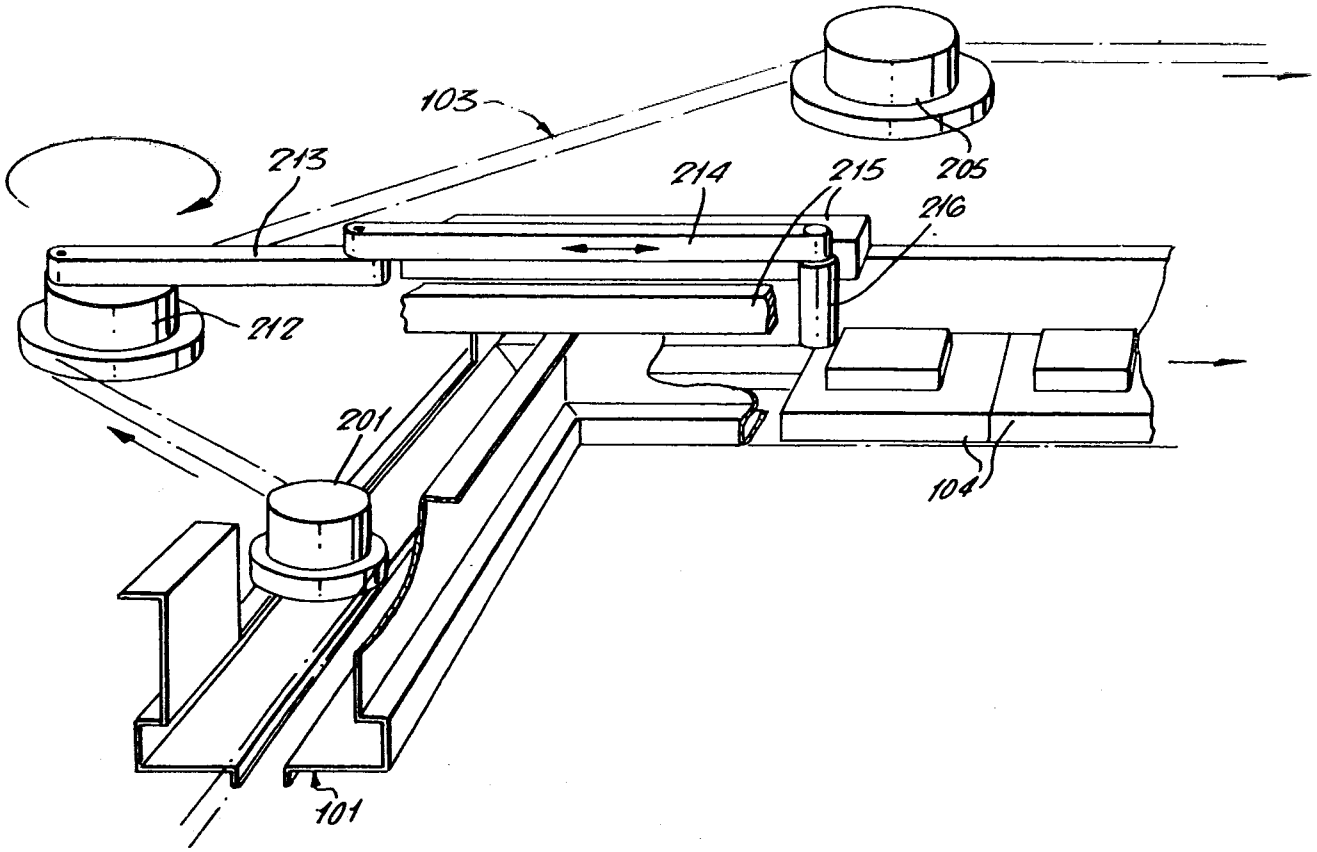
FIG. 6 is a perspective view corresponding to FIG. 5 showing the conveyor supports in an alternative position.

An alternative method of changing the direction of travel of the garment support unit at a corner of the overhead conveyor system without turning the garment itself is illustrated in FIGS. 5 and 6.

The corner 116 has been chosen to illustrate the alternative arrangement although it will be appreciated that this modification could be incorporated also at corner 115, 117 or 118.

As the conveyor chain 103 is guided around the sprocket 201 and as the block 105 of unit 104 is pushed into the corner by the pins 109, the conveyor chain is guided from the sprocket 201 around a further crank sprocket 212 and from this further sprocket directly to the sprocket 205 (illustrated in FIGS. 1 and 4). It will thus be seen that the conveyor chain does not re-enter the conveyor track 101 between the sprockets 201 and 205.

The crank sprocket 212 has a crank 213 pivotally attached to its boss, the other end of which is pivotally attached to a connecting rod 214 mounted between fixed slides 215 and carrying a downwardly depending roller pin 216.

The number of teeth on the crank sprocket 212 is equal to half the total number of chain links of the length of conveyor chain between adjacent pairs of pins 109.

The slide guides 215 are positioned above the conveyor track 101 along the centre line of the length 113.

The pin 216 and slide 215 is made from bearing material, e.g. Nylatron.

The selection of the number of teeth on the chain sprocket 212 enables two full rotations of that sprocket to take place causing through the crank 213 and rod 214 two complete cycles of the pusher pin 216 along the slide 215 for each suspension unit 104 which arrives at the corner 116.

The engagement of pin 216 with block head 108 causes rapid movement of a block assembly 105 from corner 116 to its rest position at the end of the queue of block assemblies along the length 113 of the conveyor track.

Each unit 104 is thus moved along the conveyor track length 113 at 90° to its previous direction of movement along the track length 112.

By making the stroke of the crank at least twice the length of a block 104, the garment suspended from the following block is prevented from overlapping the shoulder of the garment suspended on the hanger on the block previously moved and this prevents fouling of the garments.

Whilst, as has been described, the crank/pusher device could be used at corners 115 and 118, this would not really be satisfactory due to the complications which would arise because the conveyor chain has to re-enter the conveyor track at those corners to enable continuous movement of the block assemblies to take place.

A modification of the arrangement of the conveyor track members is illustrated in FIGS. 7 and 8 which again shows the various parts at a typical corner 116, the sprockets, the conveyor chain and/or connecting rod being omitted for clarity.

The outer and inner track sections 125 and 126 are of a simplified section which is similar to that of section 102 shown in FIG. 3 but does not have the folded slide surfaces 10. Again the sections 125 and 126 are positioned apart so that a gap 134 is created between them, the gap being larger than the gap 121 of the arrangement illustrated in FIG. 3. The block assembly 105 is replaced by a trolley unit 129 constituting a part of the garment suspension unit which unit comprises a trolley block 130 made from any suitable non-corrodible material, e.g. aluminium, and provided with wheels 131 to engage the track sections and carrying a suspension bar 106 and hook 107 similar to those illustrated in FIG. 3.

Figure 7:
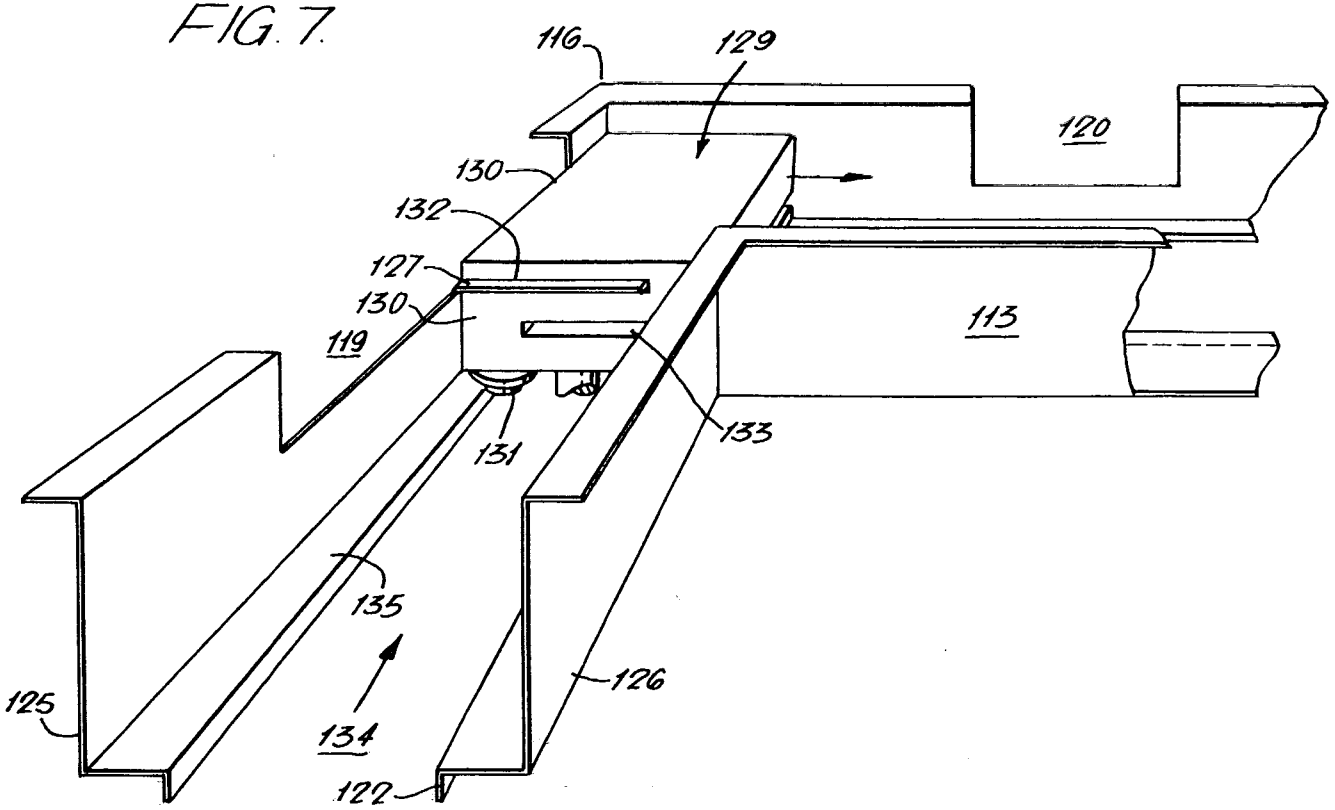
FIG. 7 is a perspective detail view of an alternative form of conveyor track member and garment suspension unit which can be used with the apparatus illustrated in either FIG. 1 or 2.
Figure 8:
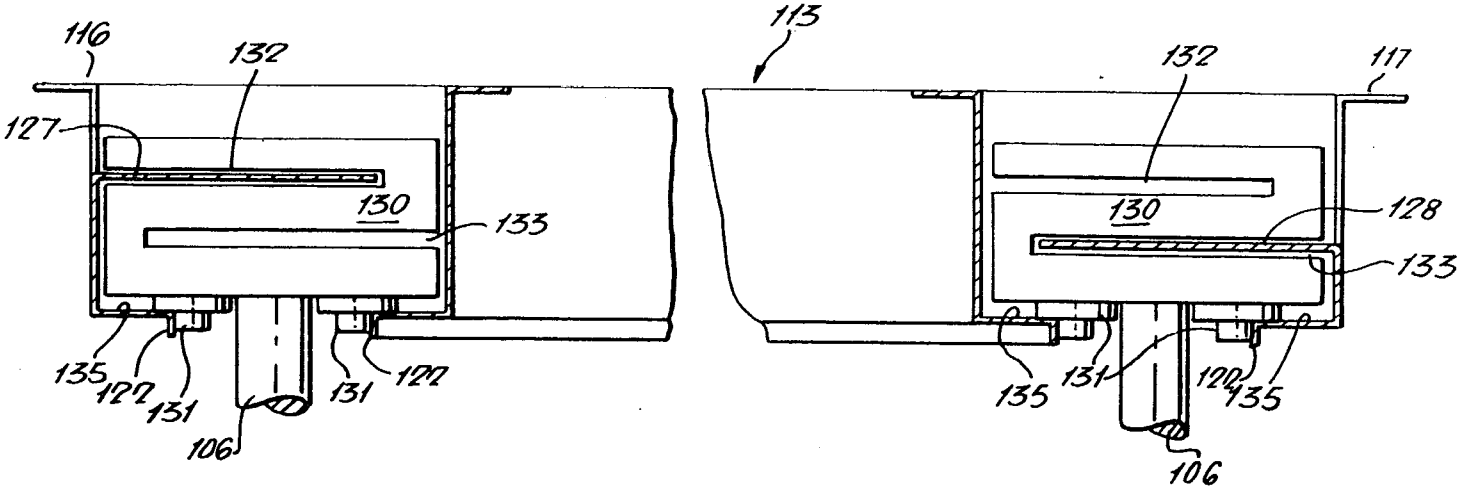
FIG. 8 is an end elevation taken in the direction of the arrow A of FIG. 7.

In the embodiment illustrated in FIGS. 7 and 8, the trolley has four wheels 131 having vertical axes located adjacent the corners of the block. The wheels are flanged so that in use these flanges slide across the horizontal portion 135 of the track sections while the spigotted portions of smaller dimensions bear against the lower downwardly depending flanges 122 in the X and Y axes depending upon the position of the block around the conveyor circuit.

As the trolley assembly 129 is pushed towards the corner 116, the leading wheel 131 engaging on the inner vertical section of the track 126 will lose contact with the track section as it traverses the gap 134 at the beginning of the next track length 113. In order to prevent the trolley assembly tipping due to lack of vertical restraint, an upper support flange 127 is provided as an extension or addition to the track sections 125, to engage in a corresponding upper slot 132 positioned at one side of the trolley block 130. It will be seen that the upper support flange 127 acts to support the block 130 whilst the block is pushed away from the corner 116 and whilst the wheels lose contact with the track.

Likewise, at the next corner 117, a lower support flange 128 (see FIG. 8) engages in a slot 133 in the other face of the trolley block 130 whilst the wheels of the block lose contact with the track at that corner.

Figure 10:
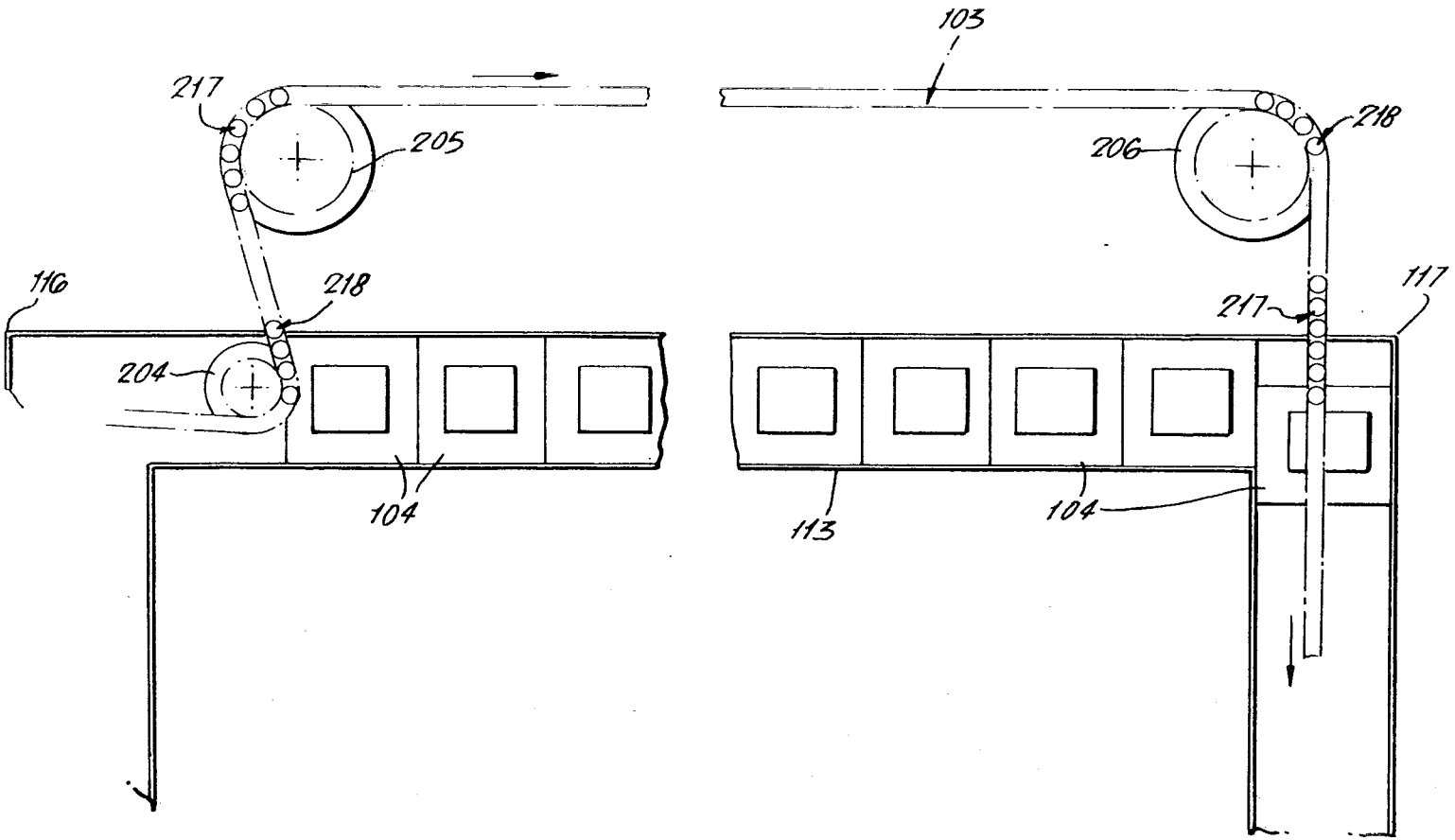

A modification of the pushing and guiding action of the pins 109 will now be described with reference to FIGS. 9 and 10.

The arrangement at corner 115 (see FIG. 9) will also apply to corner 118.

The group of pins 109 is replaced by two groups of pins 217 (leading) and 218 (lagging) associated with each block unit 104.

The number of pins in each group depends on the pitch between each block unit, the sprocket sizes on each corner and general track and chain sizes. Essentially, the leading pins 217 push and initially restrain the block in the corner and, after they have travelled around sprocket 210 to push the block unit in the new direction, the lagging pins 218 make contact with the block unit and prevent it from twisting and jambing as the block unit departs the corner.

At corner 116 (FIG. 10), the leading pins 217 push the block unit 104 up to corner 117 and the number of pins in group 217 or their distance from group 218 are such that a moderate force is applied to the block while the group of pins 217 at corner 117 re-engage the leading block unit and push it clear of the corner without jambing.

Sprockets 204 and 205 may be attached to spring-operated compensating mechanism so that, despite the accumulation of tolerances and wear on the block assemblies, the leading block may be positioned correctly in corner 117 whilst the chain 103 may be kept at the correct tension.

Figure 11:
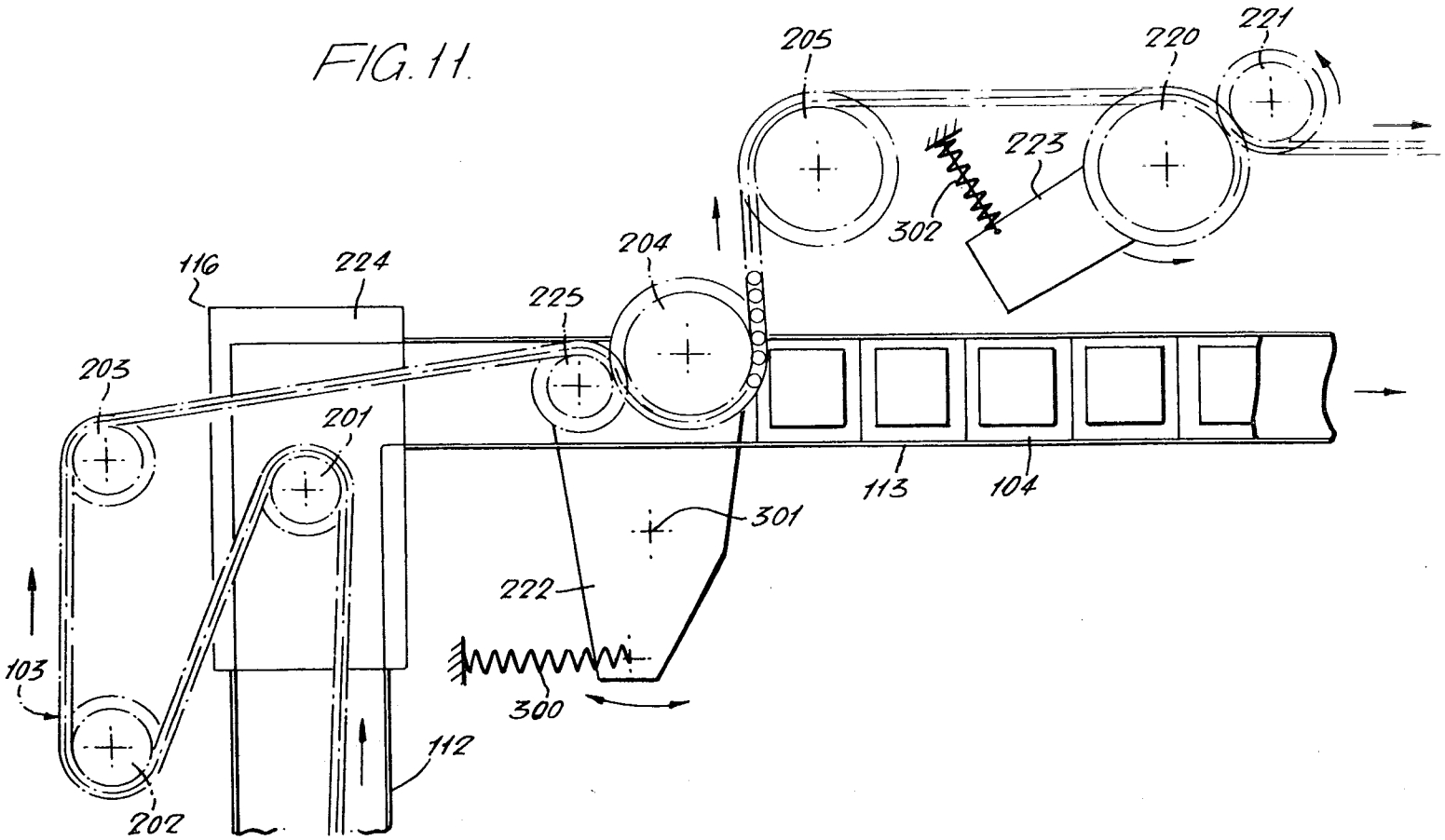
FIG. 11 is a plan view of one corner of modified apparatus according to the invention.

An example of a compensating mechanism is shown in FIG. 11 to which reference is made. FIG. 11 shows a corner 116 and a machined corner shape section 224 is provided at that corner. An additional sprocket 225 has been included with sprocket 204 such that the sprockets 225 and 204 are fixed with fixed centres on a lever 222 pivoted at the point 30 to the conveyor main frame or structure and resiliently held by a tension spring 300. This arrangement keeps the units 104 pushed up to the next corner 117 (not shown in FIG. 12) without gaps or jambing in response to accumulation of manufacturing tolerances and expansion and contraction due to subsequent temperature changes especially when large numbers of units 104 are "stacked" in the track 113.

In order to reduce or eliminate the severity of impact of a block 105 on the last block in the "stack" or queue of units 104 in track 113, the speed of the conveyor chain 103 in the direction of block travel can be reduced using the pair of sprockets 204 and 225. Thus, at the point of block to block contact, the leading pin of group 217 will be between the sprockets 204 and 225 and effectively moving slower in the "block travel direction" than the true chain conveyor speed. This becomes more important as the number of blocks in the queue in 113 increases since maximum conveyor speed increases proportionally with the machine size. The jerking and snatch action of the conveyor chain and load on the drive motor is reduced in this way.

Because the sprockets 204 and 225 move on the lever 222 in the manner shown, the conveyor chain may be subjected to tensioning or slackening and so another device must be included which allows the chain to remain at constant tension. For this purpose, sprocket 205 must be the main drive input.

On the "slack" side of the sprocket 205 another pair of sprockets 220 and 221 are mounted on a pivoted lever 223 such that the pivot of sprocket 220 is also the pivot point of the lever 223. This lever can move against the tension of a spring 302 of lower spring rate than the spring 300. Thus, pivoting of the lever 222 take priority over the lever 223.

If the length of the "stacked" blocks in track 113 increases, then lever 222 is pushed back and the spring is tensioned while the conveyor chain is slackened. The spring 302 then overcomes the chain slackness by contracting and moving the sprockets 220 and 221 about the conveyor chain and regaining correct tension and vice versa.

To assist manufacture and accurate assembly, each corner may be separated from the track sections 102 and be made as accurately machined corner shaped tracks 224 (FIG. 11) made from solid material (such as aluminium) or die-cast in a suitable material so that sections 102 may be aligned to their two ends.

Figure 12:
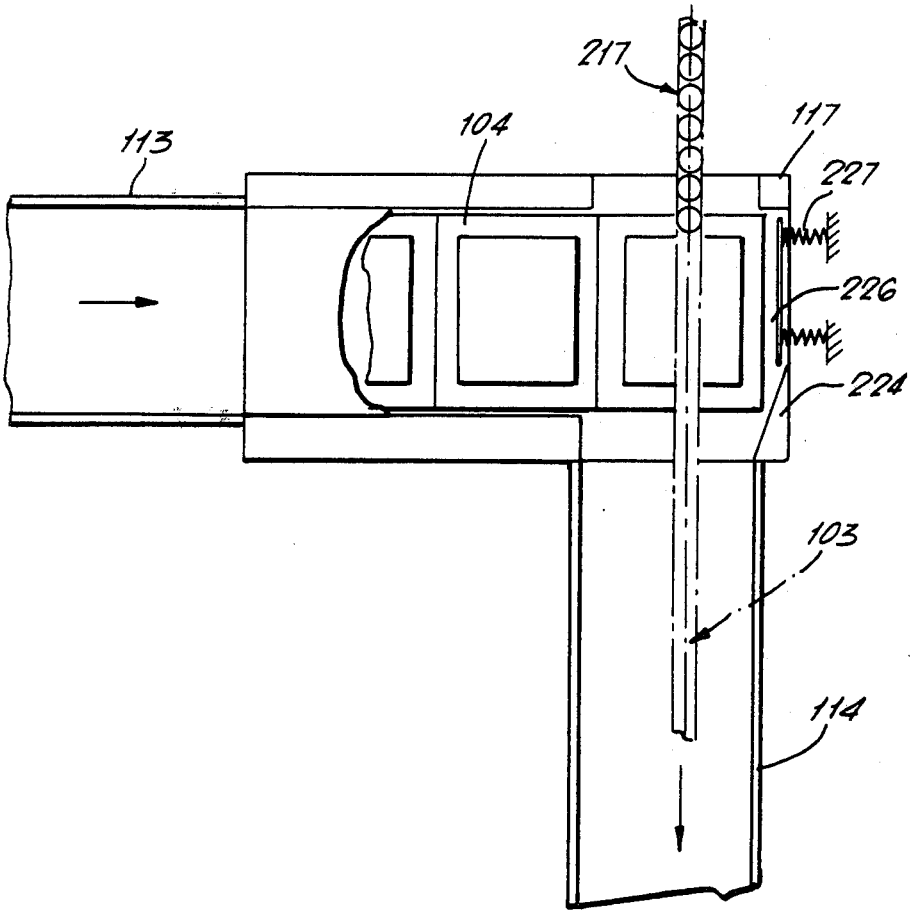
FIG. 12 is a plan view of another corner of further modified apparatus according to the invention.

The inclusion of the corner shapes 224 can be applied to all corners 115, 116, 117, 118 and the corner shape used at corner 117 may, as shown in FIG. 12, have a recess 226 which can incorporate a spring plate 227. Then in less severe examples where the queue of units 104 is not too long, the lever 222 may be preset and locked in position and any minor expansion in the block queue in track 113 may be accommodated by the leading block being pushed into the recess 226. Upon re-engagement of the leading block 104 by the chain pin group 217 the block is guided into the conveyor track 114 by a tapered "lead out" 226 from the recess. It should be noted that as the block is pushed out of the corner 117, the following blocks will not press upon it and impede its exit, because at that time the chain pin group 217 at the other end of the queue, i.e. corner 116, will not be engaged with the last to be added block in the queue and hence the whole queue may be pushed backwards slightly along the track 113.

Additionally, the blocks 105, as shown in FIG. 13, may have chamfered corners 219 in order to assist guidance past the inner corners of the track.

It will be appreciated that the movement of the garment support units around the conveyor track as described with reference to FIG. 1 is equivalent to the movement of the units along the apparatus shown in FIG. 2.

It will be appreciated that apparatus in accordance with the invention may employ only a single conveyor and enable a shorter cabinet to be employed than has been possible hitherto with previously proposed garment drive systems due to the change of speed of garment suspension units around different parts of the conveyor track.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. Garment treatment apparatus comprising:

at least one treatment cabinet, an entrance to said cabinet for garments held on garment supports, an exit from said cabinet for garments held on said garment supports, at least one conveyor for moving garments held on said supports into, through, and out of said cabinet, means for positioning and orienting said supports so that a garment on a support has its narrowest dimension substantially transverse to the direction of entry into said cabinet through said entrance, and means for changing the direction of movement of a support without rotating said support whilst said support is within said cabinet, said direction change means comprising guides defining the path of the garment supports and support blocks carrying said garment supports which are movable along said guides, said blocks having pairs of opposed faces which engage the guides so that said blocks are non-rotatably moved during movement lengthwise of the guides, the guides having corners where they change direction and the movement of a block from a corner providing the change in direction of movement of the garment support without rotation of the block, another opposed pair of faces of the block then being engaged between said guides, whereby a garment on a support may be moved through at least part of said cabinet with its said narrowest dimension aligned with the longitudinal axis of that said part of said cabinet.

2. Apparatus according to claim 1 in which a garment both enters through to said entrance to said cabinet and leaves through said exit from said cabinet with its narrowest dimension on the support substantially transverse to the direction of entry and exit from the cabinet, the direction of travel of a support being changed both after entry and again before exit without rotating the support itself.

3. Apparatus according to claim 2 in which the shoulder of a garment on the support which was leading on entry leads as the garment leaves the cabinet.

4. Apparatus according to claim 2 in which the shoulder of a garment on the support which was trailing on entry trails as the garment leaves the cabinet.

5. Apparatus according to claim 2 in which said conveyor is arranged to convey a garment support into the cabinet and to disengage from the support at the point where the direction of travel changes and re-engage the support at the point near the exit where the direction of travel is again changed, the garment supports being advanced stepwise between these points by the arrival of fresh supports at the point where the direction of travel first of all changes.

6. Apparatus according to claim 1 in which the said conveyor is an overhead conveyor and said garment supports hang from said conveyor and further comprising a loading station and an unloading station and said conveyor advancing said supports around a closed circuit from said loading station, through at least one treatment cabinet to said unloading station.

7. Apparatus according to claim 1 in which the treatment within the cabinet includes spraying, and further comprising spray means positioned adjacent said cabinet entrance so that garments carried on supports are sprayed before the change in the direction of movement of the support without rotation is made.

8. Apparatus according to claim 1 in which said conveyor is arranged to convey a garment support into the cabinet and to disengage from the support at the point where the direction of travel changes and re-engage the support at the pont near the exit where the direction of travel is again changed, the garment supports being advanced stepwise between these points by the arrival of fresh supports at the points where the direction of travel first of all changes.

9. Apparatus according to claim 1 in which said blocks have two pairs of opposed parallel sides at right angles to one another so that said block in plan view is a square.

10. Apparatus according to claim 1 in which said blocks slide on the guides and are made of a material of low friction.

11. Apparatus according to claim 1 in which said blocks have rotatable wheels on which they move along the guides.

12. Apparatus according to claim 1 in which said conveyor is a chain conveyor and said conveyor having projections spaced along its length which engage the support blocks and entrain them along said guides, said projections being disengaged at a corner of the guide.

13. Apparatus according to claim 12 in which said chain conveyor passes around a rotatable sprocket near a corner so as to disengage the projections from a block and after passage around at least one further sprocket resumes a course substantially longitudinally along the guides after a corner so that projections carried it can re-engage another side of the block and entrain it away from the corner at an angle to the previous direction of entrainment of the block to that corner.

14. Apparatus accordng to claim 12 in which said chain conveyor passes around a rotatable sprocket near a corner so as to disengage the projections from the block and further comprising a reciprocatable piston rod driven by said chain conveyor which engages a block at said corner and moves said block away from the corner at an angle to the previous direction of entrainment of said block to that said corner.

15. Apparatus according to claim 12 further comprising a pair of sprockets and a resiliently pivoted lever on which said pair of sprockets is mounted, said chain conveyor passing around said pair of sprockets.

* * * * *